US006482114B1

(12) United States Patent
Eggiman et al.

(10) Patent No.: US 6,482,114 B1
(45) Date of Patent: Nov. 19, 2002

(54) BAT AND METHOD OF MANUFACTURING

(75) Inventors: Michael D. Eggiman, Hillsboro, OR (US); Mark A. Fritzke, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/609,122

(22) Filed: Jul. 3, 2000

(51) Int. Cl.[7] ..... A63B 59/06
(52) U.S. Cl. ..... 473/566
(58) Field of Search ..... 473/564–568, 473/FOR 189, FOR 457

(56) References Cited

U.S. PATENT DOCUMENTS

| | | | | |
|---|---|---|---|---|
| 3,861,682 A | | 1/1975 | Fujii | |
| 3,876,204 A | | 4/1975 | Moore et al. | |
| 3,963,239 A | | 6/1976 | Fujii | |
| 4,569,521 A | | 2/1986 | Mueller | |
| 4,600,193 A | | 7/1986 | Merritt | |
| 4,720,104 A | * | 1/1988 | DiSieno | 473/566 |
| 5,104,123 A | | 4/1992 | Okitsu | |
| 5,364,095 A | | 11/1994 | Easton et al. | |
| 5,415,398 A | | 5/1995 | Eggiman | |
| 5,458,330 A | | 10/1995 | Baum | |
| 5,511,777 A | | 4/1996 | McNeely | |
| 5,722,908 A | | 3/1998 | Feeney et al. | |
| 6,053,828 A | * | 4/2000 | Pitsenberger | 473/566 |
| 6,143,429 A | * | 11/2000 | Abkowitz et al. | 473/566 |
| 6,176,795 B1 | * | 1/2001 | Schullstrom | 473/566 |

FOREIGN PATENT DOCUMENTS

| | | |
|---|---|---|
| JP | 51-13165 | 8/1976 |
| JP | 4-303477 | 10/1992 |
| JP | 5-23407 | 2/1993 |

* cited by examiner

*Primary Examiner*—Mark S. Graham

(57) ABSTRACT

A bat having an elongate impact portion includes a first tubular metal member and a second tubular member substantially concentric with the first tubular member. The first and second tubular members have close fitting cylindrical surface throughout a majority of the length of the impact portion and a lubricating material is interposed between the facing cylindrical surfaces.

6 Claims, 2 Drawing Sheets

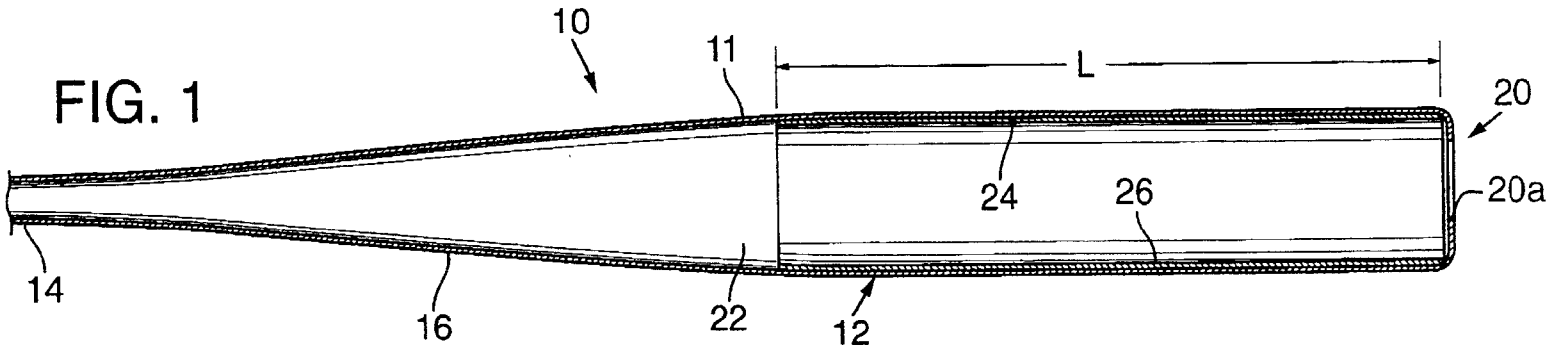
FIG. 1
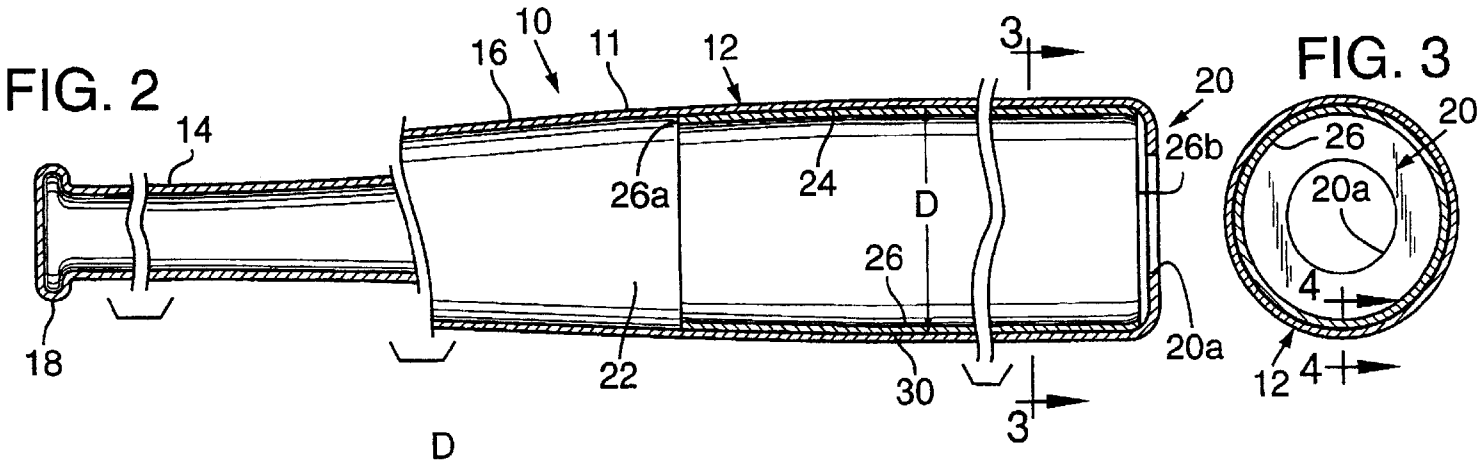
FIG. 2
FIG. 3
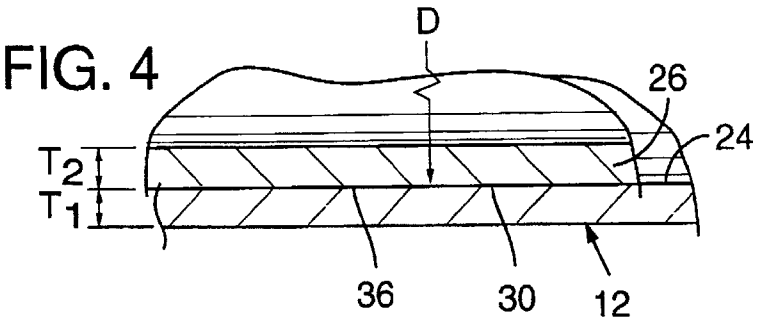
FIG. 4

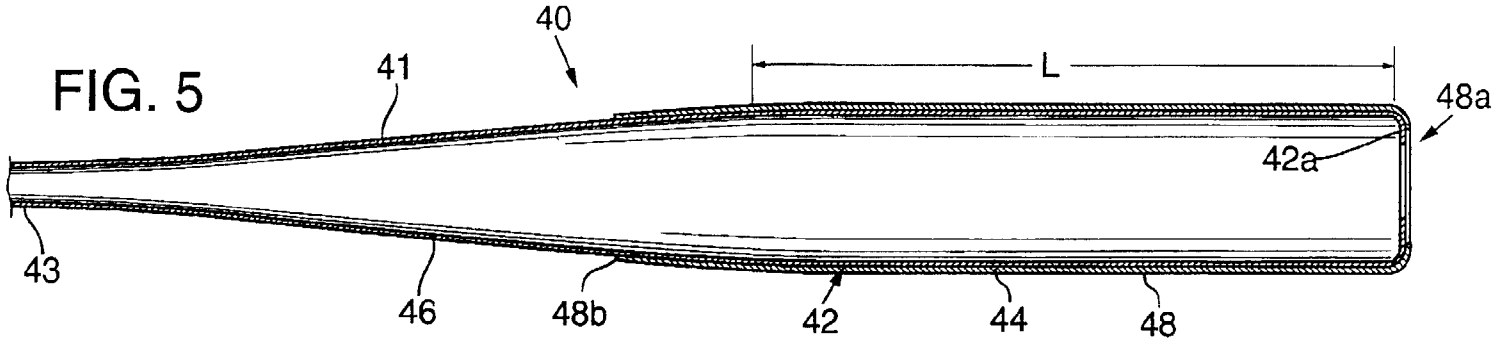
FIG. 5
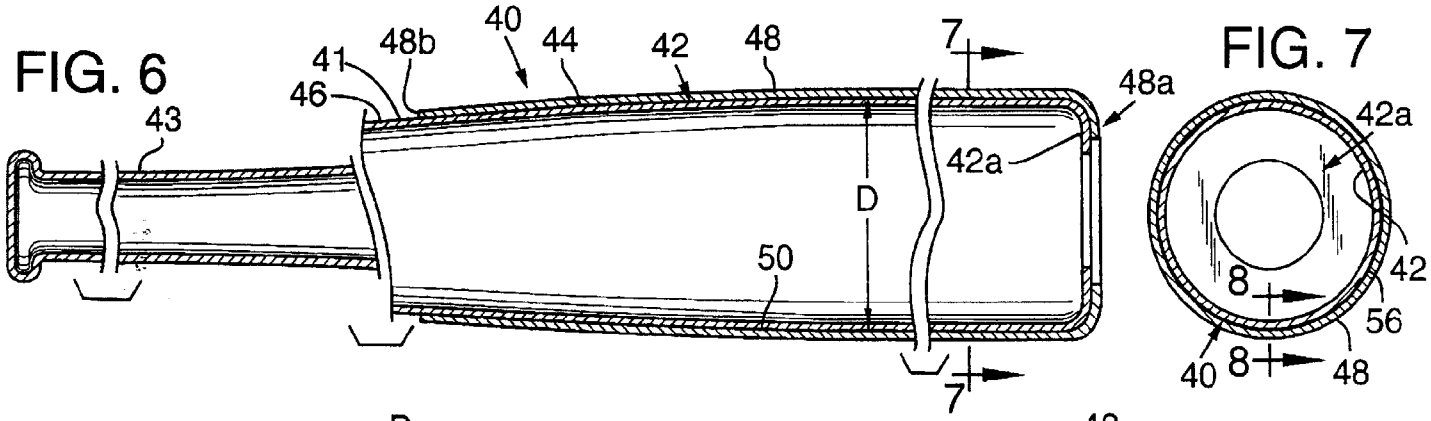
FIG. 6
FIG. 7
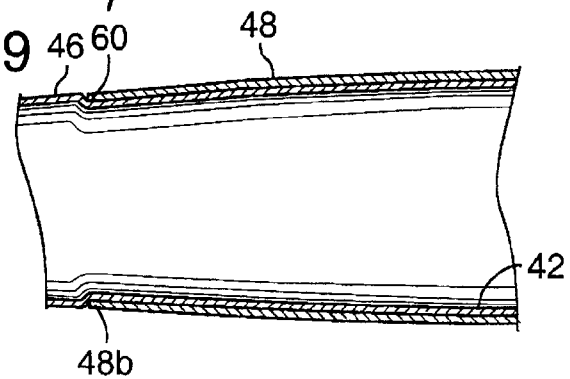
FIG. 9
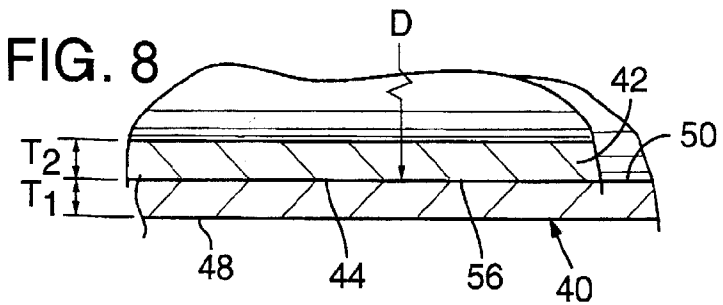
FIG. 8

BAT AND METHOD OF MANUFACTURING

FIELD OF INVENTION

This invention relates to a bat, and more particularly to a bat with inner and outer tubular members with lubricating material therebetween, and a method for manufacturing such.

BACKGROUND AND SUMMARY OF THE INVENTION

Tubular metallic softball and baseball bats are well known in the art. A familiar example is a tubular aluminum bat. Such bats have the advantage of a generally good impact response, meaning that the bat effectively transfers power to a batted ball. This effective power transfer results in ball players achieving good distances with batted balls. An additional advantage is improved durability over crack-prone wooden bats.

Even though present aluminum bats perform well, there is an ever-continuing quest for bats with better hitting capability. Accordingly, one important need is to optimize the impact response of a bat. Generally speaking, impact response is best when a bat undergoes the greatest elastic deflection, before rebounding with the greatest force in the longest amount of time. Optimization of these factors increases the "spring" of a ball off a bat, yielding a bat with superior power transfer and facility for "slugging."

Further constraining the design of aluminum bats is the requirement that the elastic deflection not be accompanied by any plastic deformation. Plastic deflection lessens the power transferred to a ball and leaves the bat permanently dented. Thus, aluminum bat design is driven by the elastic and plastic deformation characteristics of aluminum. For example, when the tubular wall is too thin, a desirable large amount of elastic deflection is achieved, but with unwanted permanent plastic deformation. On the other hand, when the aluminum tubular wall is too thick, the bat may be too stiff to elastically deflect appreciably. In this case, the bat responds with relatively little spring, resulting in lower power transfer.

The prior art includes tubular bats using inserts. Most often inserts are used for vibration deadening purposes. U.S. Pat. No. 3,963,239 to Fujii discloses a metallic bat frame with a large-diameter impact portion receiving an insert to adjust the weight and improve the "repelling action" of the bat. Fujii teaches an insert in tight abutment within the tubular frame, so that the insert is fixed relative to the frame. The engagement is improved by forcing the insert into the tapered intermediate portion of the bat and/or by gluing the insert within the frame. The tightly fitted Fujii insert simply acts to thicken the wall of the impact portion of the bat.

In light of the shortcomings of the prior art, it is an object of the present invention to provide an improved bat.

It is another object of the invention to provide a simple construction for a tubular bat with inner and outer tubular members.

In accordance with an embodiment of the present invention, a bat having an elongate impact portion is formed with a first tubular member, and a second tubular member substantially concentric with the first tubular member. The first and second tubular members have close fitting facing cylindrical surfaces throughout a majority of the length of the impact portion and lubricating material is interposed between the facing cylindrical surfaces.

Further, in accordance with an embodiment of the present invention, an elongate tubular metal member has a circular striking portion, with the striking portion having an interior surface defining an interior cavity. An elongate tubular metal insert is located within the interior cavity and has an exterior surface complementary to, and throughout a majority of its length fitting against, the interior surface of the striking portion. Lubricating material is interposed between the interior surface and the exterior surface to permit relative movement between the insert and the surrounding tubular member when a ball is batted.

Another object of the present invention is to provide a method for producing an improved bat.

BRIEF DESCRIPTION OF THE DRAWINGS

FIG. 1 is a sectional view through the longitudinal center of a bat in accordance with one embodiment of the invention.

FIG. 2 is a magnified sectional view of the bat of FIG. 1 with portions broken away.

FIG. 3 is a cross-sectional view taken generally along the line 3—3 of FIG. 2.

FIG. 4 is an enlarged view taken generally along the line 4—4.

FIG. 5 is a cross-sectional view through the longitudinal center of bat in accordance with a second embodiment of the invention.

FIG. 6 is a magnified sectional view of the bat of FIG. 5 with portions broken away.

FIG. 7 is enlarged view taken generally along the line 7—7 in FIG. 6.

FIG. 8 is an enlarged view taken generally along the line 8—8 in FIG. 7.

FIG. 9 is a partial sectional view similar to FIG. 6, of a third embodiment.

DETAILED DESCRIPTION

Referring to FIG. 1, tubular ball bat 10 comprises an elongate tubular metal member 11 having a ball striking, or impact portion, 12, handle portion 14, and a tapered transition portion 16 that extends between the handle portion 14 and striking portion 12. As shown here, the impact, or ball striking, portion 12 has an elongate cylindrical shape. The impact portion 12 has a larger diameter than the handle portion 14. The transition portion 16 joins the impact portion 12 and handle portion 14 and accordingly tapers in diameter from one end to the other. A knob 18 is provided at one end of the handle portion.

The distal end 20 of the impact portion 12 is initially open to facilitate manufacture of the bat. However, at the end of the forming process, the distal end portion is formed over as illustrated in FIGS. 1–3 to partially enclose the distal end of the bat. A circular opening 20*a* is provided which may be closed by a plug (not shown).

The tubular metal member 11 forms the exterior of the ball bat and has a hollow interior, or interior cavity, 22 that extends the entire length of the bat. The striking, or impact, portion 12 has an interior surface 24 defining a portion of the interior cavity extending through the impact portion.

To provide improved hitting with the bat, an elongate tubular metal insert 26 is disposed within cavity 22 in impact portion 12.

The impact portion 12 has a defined length indicated generally at L. The interior surface 24 has a substantially cylindrical cross-section having a diameter indicated generally at D. Normally diameter D would be in a range of from 2 to 2.75 inches.

The tubular metal insert 26, has an outer wall, or exterior, surface 30 complementary to the shape of interior surface 24. Insert 26 has a length which is a majority of the length L of the impact portion and is preferably, as shown in the illustrations, though not necessarily substantially equal to length L. Normally length L would be in a range of from 12 to 16 inches.

Referring to FIG. 4, the thickness of the metal material forming the impact portion 12 of the tubular metal bat member 10 is indicated generally at $T_1$, while the thickness of the material forming insert 26 is noted at $T_2$.

Referring still to FIG. 4, a layer of lubricating material 36 is interposed between the interior surface 24 of impact portion 12 and the exterior surface 30 of insert 26.

A first end 26*a* of the tubular insert, or sleeve, 26 preferably is inserted within the impact portion to be forcefully lodged in abutment with the diametrically narrowing interior wall of the tapering portion 16, which inhibits movement of the insert in the direction toward the handle of the bat. A second, or distal, end 26*b* of the tubular insert, or sleeve, 26 is adjacent distal end 20 of the bat. The outermost, or topmost, portion of the impact portion of the bat indicated at 20*a* is preferably curled inwardly over end 26*b* to produce a reduced-diameter head, or stop, portion for the bat which inhibits movement of insert 26 in the direction of the curled over end of the bat.

The interior surface 24 of the impact portion 12 is substantially continuously cylindrical, and the exterior surface 30 of the insert is substantially continuously cylindrical having a shape which is complementary to, and when assembled fits with a slight interference fit against, the interior surface of the tubular outer member throughout the majority of the length of the insert. The slight interference fit in a preferred embodiment of the invention may be in a range of 0.0005 to 0.004 inch as measured radially of the bat.

The lubricating material 36 between interior surface 24 and exterior surface 30 is interposed between all contiguous portions of these two surfaces of the tubular metal bat member and the insert. The lubricating material is an important feature of the assembly and may be any material which will permit relative movement between the impact portion 12 and insert 26. Some examples of materials that may be used are solid lubricants such as Teflon, fluid lubricants such as grease, or other appropriate lubricants. The lubricating material permits relative movement between the impact portion and the insert, even though the insert fits closely in a slight interference fit with the tubular outer member. This close engagement between the metal frame and insert, combined with a permitted amount of relative movement allowed therebetween by the lubricating material provides good striking performance, while supporting the outer tubular member against plastic deformation upon striking a ball.

In one embodiment, both the tubular outer member and the insert are made of aluminum. The outer bat portion is formed by swaging from an aluminum tube to yield an integral weld-free outer member having the impact portion, handle, and transition portion as previously described. While swaging has been noted as a means of producing the outer member, it should be understood that other methods of manufacturing may work equally as well. As noted, the outer member is formed with a circular cross-section having a striking portion, which has a cylindrical interior surface defining an interior cavity of selected first cross-sectional dimension when at a normal ambient temperature.

The insert 24 also is formed generally of a tubular metal material, which may be aluminum, steel, titanium, or any other suitable material. However other materials, such as carbon fiber, may be used. The insert is formed into a shape having a cylindrical exterior surface complementary in shape to the interior surface. The insert has a second cross-sectional dimension at normal ambient temperature, which is slightly greater than the first interior dimension of the striking portion. The thickness of the material of the impact portion 12 denoted generally at $T_1$, is in a range of 0.04 to 0.110 inches, while the thickness of insert 26 denoted generally at $T_2$ is in a range of 0.04 to 0.110 inches.

The outer diameter of the insert is such that at normal ambient temperature it is slightly greater than the interior diameter of the outer member at ambient temperature. Noting that the diameter of the interior surface at normal ambient temperature is denoted generally at D the exterior surface diameter of the insert when initially formed at normal ambient temperatures could be in a range of (D+0.001) inch to (D+0.008) inch.

In initial forming, the distal end 20 of the outer tubular member 12 has not been curled in as shown. Instead it would be formed to produce a full open cavity mouth into which insert 26 may be inserted.

Prior to assembly either the external surface of the insert 26 or the interior surface of the impact area 12 are coated with an appropriate lubricating material 36. This lubricating material may be Teflon, grease, or other appropriate lubricant, which may be applied to the outer surface of the insert by spraying, rolling, or hand application, or to the interior surface of the impact portion. This is not meant as an exclusive list since other materials and application methods may work also.

The impact portion 12 of the outer member may be heated to a temperature sufficiently above normal ambient temperature to cause the interior cavity to expand to at least the external cross-sectional dimension of the insert. Conversely, the insert could be cooled below ambient temperature to cause it to shrink in cross-sectional dimension to less than the interior cavity cross-section dimension. In other words, a temperature differential may be produced between the outer member and the insert so that the insert may be slid into the outer member. While the temperature differential exists between the parts the insert is moved into the internal cavity to the position shown in FIGS. 1, 2 and 3. The bat parts then are allowed to return to ambient temperature to produce a slight interference fit between the outer member and the insert, with the lubricating material therebetween.

In other embodiments of the invention, in place of Teflon or grease, one of interior surface 24 and exterior surface 30 may be anodized to permit a degree of slippage between the outer member and the insert upon impact.

Referring to FIGS. 5–8 a second embodiment of the invention is illustrated. A ball bat 40 comprises an elongate tubular metal member 41 having a ball striking, or impact portion 42, handle portion 43 and transition-tapered portion 46. The striking, or impact, portion 42 has an exterior surface 44.

To provide improved hitting with the bat, an elongate tubular member, in the form of a sleeve 48 is disposed about portion 42 of the tubular member 41. The bat thus has an elongate impact portion with a defined length indicated generally at L formed by a combination of portion 42 of tubular member 41 and tubular member, or sleeve, 48. These bat parts are substantially concentric and have close fitting facing cylindrical surfaces throughout a major portion of the length of the impact portion L. Generally the thicknesses of the tubular members would be similar to that previously discussed in relation to the embodiment illustrated in FIGS. 1–4 and a similar close, or slight interference, fit would be provided therebetween.

As is best seen in FIGS. 5 and 6 the distal end of portion 42 is curled inwardly to form a rounded outer end 42*a*, and the distal end 48*a* of the sleeve 48 also is curled inwardly over the outer end of section 42*a*. Sleeve 48 is slightly longer than impact section L of tubular member 41 and the portion adjacent end 48*b* is formed inwardly to follow the general taper of tapered section 46 of tubular member 41. This generally secures the sleeve 48 against shifting inwardly or outwardly longitudinally of member 41.

Referring to FIGS. 7–8, a layer of lubricating material 56 is interposed between the exterior surface 44 of impact portion 12 and the interior surface 50 of sleeve 46.

As with the embodiment illustrated in FIGS. 1–4, the interior surface of sleeve 46 is substantially continuously cylindrical except for the curled over distal end 48*a* and inwardly tapered portion 48*b*. The exterior surface of impact portion 42 is substantially continuously cylindrical also, having a shape which is complementary to, and when assembled, fits in a slight interference fit against the interior surface of the sleeve throughout a majority of the length of the impact portion L. The slight interference fit in a preferred embodiment being in a range of 0.0005 to 0.004 inch as measured radially of the bat.

Lubricating material 56 is interposed between all contiguous parts of these two surfaces and may be of materials similar to and applied similarly as described above. The materials used for the tubular portions also may be similar to those described above with similar thicknesses and other sizes.

In the embodiment illustrated in FIGS. 5–8, the inner diameter of sleeve 48 is indicated generally at D when initially formed at normal ambient temperature. The exterior surface diameter of tubular portion 42 when initially formed at normal ambient temperature could be in a range of (D+0.001) inch to (D+0.008) inch.

Prior to assembly either the external surface of tubular portion 42 or the interior surface of sleeve 48 is coated with an appropriate lubricating material 56. Such may be of materials and applied as set out for the previously described embodiment. Either the sleeve 48 is heated above ambient temperature or the tubular metal impact portion 42 is cooled sufficiently below ambient temperature, such that a temperature differential exists between the parts to allow the sleeve to be slid over the tubular bat frame 42 to the position illustrated in FIGS. 5–8. After the parts thus have been assembled they are allowed to return to ambient temperatures which produces a close fitting, or slight interference fit, with lubricating material interposed therebetween.

FIG. 9 is a partial sectional view similar to FIG. 6 of a third embodiment. Here tapered portion 46 has an annular ridge 60 formed therein of a height substantially equal to the thickness of sleeve 48. The inner end 48*b* of sleeve 48 rests against the ridge, thus to provide a substantially constant outer surface configuration for the tapered portion 46 and sleeve 48, while maintaining the general structural and functional capabilities and characteristics of the bat thus described.

In view of the many possible embodiments to which the principles of the present invention may be put, it should be recognized that the detailed embodiments set out herein are illustrative only and should not be taken as limiting the scope of the invention. Rather, I claim as my invention all embodiments as may come within the scope and spirit of the following claims and equivalence thereto.

We claim:

1. A bat comprising an elongate tubular metal member having a circular cross-section with a striking portion adapted to engage a ball, said striking portion of the member having an interior surface defining an interior cavity, and an elongate tubular metal insert having an exterior surface complementary to and through out a majority of its length fitting against said interior surface, at least one of said surfaces having a friction-reducing anodized coating adapted to enable relative movement between the insert and the striking plate, the insert located within said interior cavity and operably movable relative to said striking portion.

2. The bat of claim 1, wherein the insert is made of a material selected from the group consisting of aluminum, titanium, steel, other alloys and carbon fiber.

3. The bat of claim 1, wherein the striking portion of the member has a wall thickness in the range of 0.04 to 0.110 inches.

4. The bat of claim 1, wherein the insert has a wall thickness in the range of 0.04 to 0.110 inches.

5. The bat of claim 1, wherein the insert is disposed in the member such that a slight interference fit exists between the exterior surface of the insert and the interior surface of the member.

6. The bat of claim 5, wherein the slight interference fit is in a range of 0.0005 to 0.004 inches as measured radially of the bat.

* * * * *